US007717483B1

(12) United States Patent
Bombara

(10) Patent No.: US 7,717,483 B1
(45) Date of Patent: May 18, 2010

(54) SERVER TRAY ASSEMBLY

(76) Inventor: Peter Bombara, 133 Bay 28th St., Brooklyn, NY (US) 11214

( * ) Notice: Subject to any disclaimer, the term of this patent is extended or adjusted under 35 U.S.C. 154(b) by 279 days.

(21) Appl. No.: 11/901,867

(22) Filed: Sep. 19, 2007

(51) Int. Cl.
*A47G 23/06* (2006.01)
*B65D 1/34* (2006.01)

(52) U.S. Cl. ..... 294/172; 294/144; 206/557

(58) Field of Classification Search ..... 294/25, 294/144, 172; 206/557; 220/556
See application file for complete search history.

(56) References Cited

U.S. PATENT DOCUMENTS 2,723,068 A * 11/1955 Ettwein ..... 294/144
3,162,344 A * 12/1964 Sabol ..... 294/143
3,504,832 A * 4/1970 Corvetti ..... 294/144
5,662,240 A * 9/1997 Norris ..... 220/574
5,803,265 A * 9/1998 Bergerman ..... 206/557
6,145,906 A * 11/2000 Wright et al. ..... 294/172
2006/0032780 A1* 2/2006 Heyn ..... 206/557
2007/0215512 A1* 9/2007 Bellissimo ..... 206/557

* cited by examiner

*Primary Examiner*—Dean J Kramer
(74) *Attorney, Agent, or Firm*—Law Offices of JD Geraigery; Janine D. Geraigery

(57) ABSTRACT

A serving tray assembly has a substantially circular plate including, a top and a bottom and two substantially elongated oval openings extending from the top to the bottom. The plate has an outer perimeter having an integrally coupled upwardly extending edge including a top having a lip. A tray is integrally coupled to the plate. A substantially elongated rectangular strap including a top surface and a bottom surface, a first end and a second end. The first end includes a substantially square and hollow clasp, wherein the top surface of the second end includes two substantially elongated strips of hook and loop fastener spaced apart.

5 Claims, 2 Drawing Sheets

SERVER TRAY ASSEMBLY

BACKGROUND OF THE INVENTION

1. Field of the Invention

The invention relates to serving trays, and more particularly, to an improved serving tray assembly having an adjustable strap integrally coupled to the bottom of the tray for allowing a waiter to secure their hand to the bottom of the tray, thereby preventing the tray from falling during transport and serving.

2. Description of the Related Art

Waiters are responsible and accountable for many restaurant tasks, but the most important always seems to be the transporting of food and beverages to the patrons of a restaurant or cocktail party. When delivering several drinks, food, or other utensils, it is extremely important to have a stable tray from which to serve. It is all too common, sitting in a restaurant, to hear a tray fall to the ground and the drinks or food thereon crash to the floor. Not only does this create a huge mess to clean-up, but it also is extremely costly when food needs to be re-prepared, and aggravates patrons who have to wait even longer for their food.

Currently, standard serving trays are available on the market, but have yet to increase with the times. While these units may be suitable for the particular purpose employed, or for general use, they would not be as suitable for the purposes of the present invention as disclosed hereafter.

SUMMARY OF THE INVENTION

It is an object of the invention to produce a means for preventing serving trays from falling out of the hands of servers, waiting on tables in busy restaurants. Accordingly, the invention is an improved serving tray assembly having an adjustable strap integrally coupled to the bottom of the tray.

It is another object of the invention to provide a serving stray that can quickly and easily secure to the hand of the waiter. The serving tray of the present invention allows a waiter to easily secure their hand to the bottom of the tray, thereby preventing the tray from falling during transport and serving.

It is yet another object of the invention to provide a serving tray that can easily be adapted to accommodate waiters having different size hands.

It is another object of the invention to provide a serving tray affordable to construct and manufacture.

This invention is a serving tray assembly having a substantially circular plate including, a top and a bottom and two substantially elongated oval openings extending from the top to the bottom. The plate has an outer perimeter having an integrally coupled upwardly extending edge including a top having a lip. A tray is integrally coupled to the plate. A securing means including a substantially elongated rectangular strap including a top surface and a bottom surface, a first end and a second end. The first end includes a substantially square and hollow clasp, wherein the top surface of the second end includes two substantially elongated strips of hook and loop fastener spaced apart.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
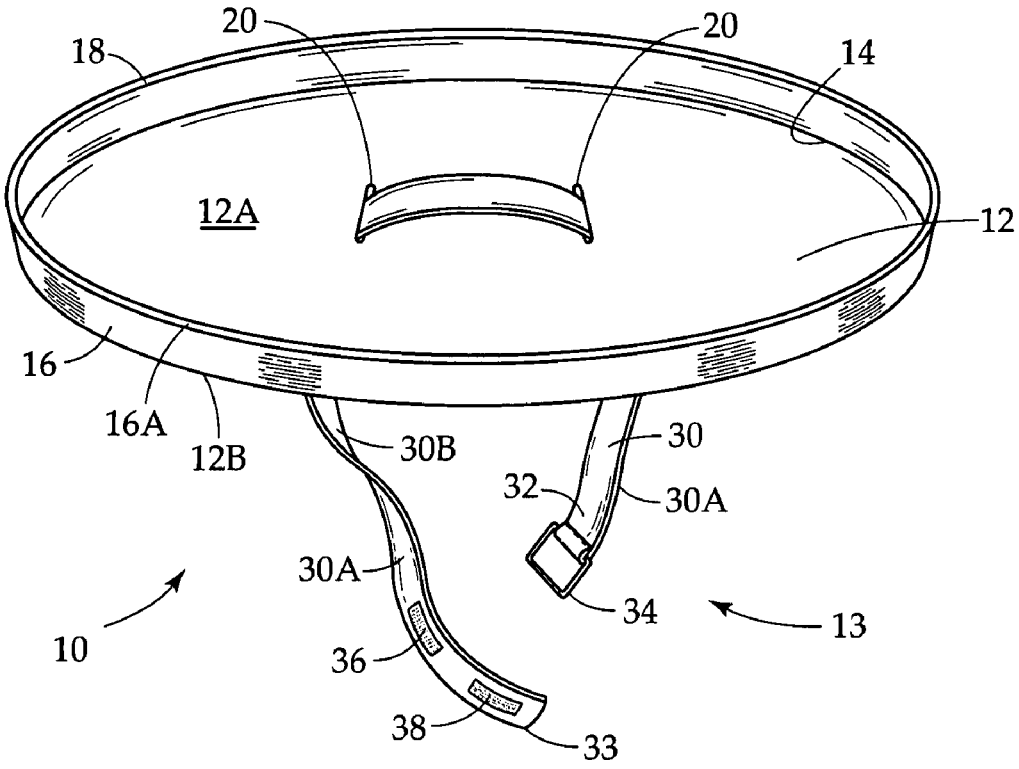
FIG. 1 is a diagrammatic perspective view of a serving tray assembly of the present invention, having a bottom including an integrally coupled adjustable strap.

FIG. 1 illustrates an improved serving tray assembly 10 of the present invention. The serving tray 10 includes a substantially circular plate 12. The plate 12 includes an outer perimeter 14. An upwardly extending edge 16 is integrally coupled to the outer perimeter 14 and preferably extends upwardly in a perpendicular orientation from the plate 12. The edge 16 includes a top 16A. The top 16A of the edge 16 can include a lip 18.

The plate 12 also includes a top 12A and a bottom 12B. Two substantially elongated oval openings 20 extend from the top 12A to the bottom 12B of the plate 12.

A securing means 13 is used to hold the hand of the waiter to the bottom 12B of the plate 12. In the preferred embodiment, a substantially elongated rectangular strap 30 is used to secure a waiter's hand to the plate 12. However, other securing means are contemplated including, but not limited to both rigid and non rigid materials, both integrally coupled and removable coupled to the bottom 12B of the plate 12, for example, adhesive straps, a fixed elastic strap, a button strap.

Figure 3:
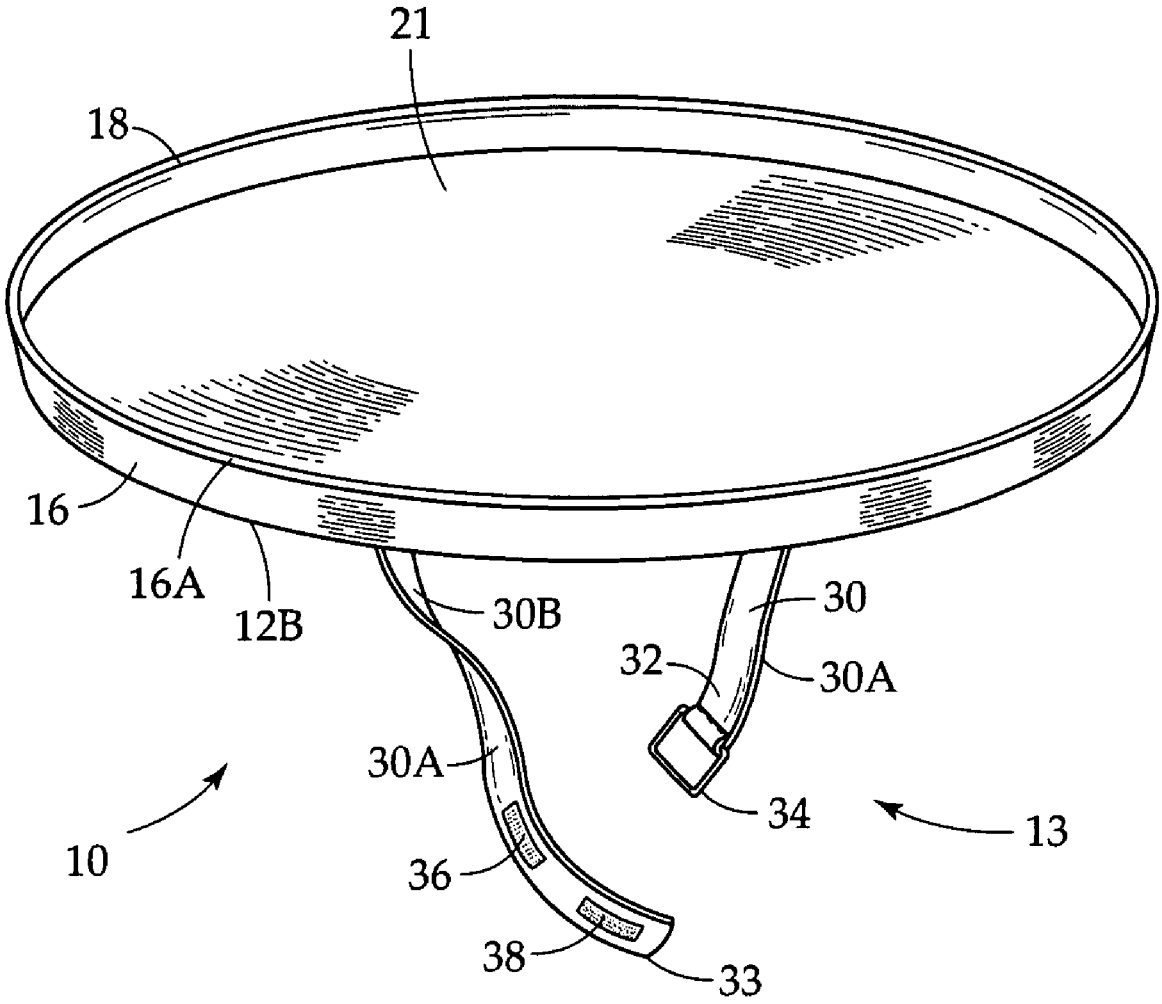
FIG. 3 is a diagrammatic perspective view of the serving tray assembly of the present invention, where a tray is coupled over the plate to allow for a flat smooth serving surface.

In addition, as shown in FIG. 3, a substantially circular tray 21 is integrally coupled to the top 12A of the plate 12 for concealing the securing means 13 and allowing waiters to place items thereon. The tray 21 may be coupled by adhesion or other like method.

The strap 30 of the preferred embodiment includes a top surface 30A and a bottom surface 30B, and a first end 32 and a second end 33. The first end 32 includes a substantially square and hollow clasp 34 integrally coupled thereto. The top surface 30A of the second end 33 includes two substantially elongated strips of hook and loop fastener, including a first strip and a second strip 36 and 38 respectively. The two strips of hook and loop fastener 36 and 38 are preferably spaced apart from one another for accommodating the hollow clasp 34 when in use.

Figure 2:
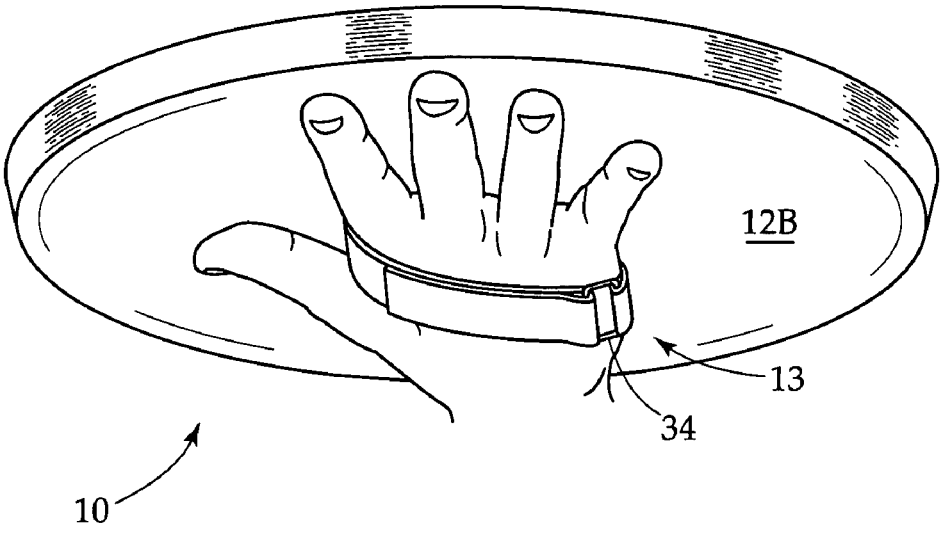
FIG. 2 is a diagrammatic perspective view of the serving tray assembly of the present invention in use, where the adjustable strap includes a buckle and hook and loop fastener and is shown secured to a hand of a waiter.

FIG. 2 illustrates a bottom diagrammatic perspective view of the improved serving tray assembly 10. In use, the second end 33 of the strap 30 extends up through one elongated oval opening 20 and down through the other elongated oval opening 20. The tray 21 is then, if it is not already, integrally coupled to the plate. A waiter places their hand against the bottom 12B of the plate and then adjustable fastens the strap 30 securely around their hand. To secure the strap 30, the second end 33 of the strap is brought over the hand of the waiter and fed through the clasp 34 at the first end 32 of the strap 30. Then, after the second end 33 is fed through the clasp 34, the strap secures to itself by allowing the first strip of hook and loop fastener 38 to couple with the second strip of hook and loop fastener 36.

When secured as such, the strap 30 lies flush between the tray 21 and plate 12 and does not interfere with plates or glassware being transported.

In conclusion, herein is presented an improved serving tray assembly. The invention is illustrated by example in the drawing figures, and throughout the written description. It should be understood that numerous variations are possible, while adhering to the inventive concept. Such variations are contemplated as being a part of the present invention.

What is claimed is:

1. A serving tray assembly, comprising:

a substantially circular plate including a top, a bottom and two substantially elongated oval openings extending from the top to the bottom, and having an outer perimeter having an upwardly extending edge integrally coupled to said outer perimeter extending upwardly in a perpendicular orientation from said plate, the edge including a top having a lip;

a substantial circular tray is integrally coupled to the top of the plate; and a substantially elongated rectangular strap including a top surface and a bottom surface, and a first end and a second end, the first end including a substantially square and hollow clasp integrally coupled thereto, wherein the top surface of the second end including two substantially elongated strips of hook and loop fastener, including a first strip and a second strip spaced apart.

2. A method for removably securing a hand of a waiter to the bottom of a serving tray assembly of claim 1, the steps comprising:

extending the second end of the strap up through one elongated oval opening and down through the other elongated oval opening;

coupling the tray to the top of the plate;

placing the hand against the bottom of the plate;

fastening the adjustable strap securely around the hand, by bringing the second end of the strap over the hand of the waiter and feeding the second end through the clasp at the first end of the strap; and allowing the first strip of hook and loop fastener to couple with the second strip of hook and loop fastener.

3. A serving tray assembly, comprising a substantially circular plate including a top, a bottom, and an outer perimeter having an upwardly extending edge integrally coupled to said outer perimeter extending upwardly in a perpendicular orientation from said plate, the edge including a top having a lip, wherein said plate includes two substantially elongated oval openings extending from said top to said bottom;

a substantial circular tray is integrally coupled to the top of the plate; and a securing means is coupled to the bottom of the plate for holding a hand of a waiter therein, wherein said securing means is a substantially elongated rectangular strap including a top surface and a bottom surface, and a first end and a second end.

4. The serving tray assembly of claim 3, wherein the first end of the strap includes a substantially square and hollow clasp integrally coupled thereto, wherein the top surface of the second end includes two substantially elongated strips of hook and loop fastener, including a first strip and a second strip.

5. The serving tray assembly of claim 4, wherein the first and second strip are spaced apart for accommodating the clasp.

* * * * *